US011864616B2

(12) United States Patent
Rahmatyan

(10) Patent No.: US 11,864,616 B2
(45) Date of Patent: Jan. 9, 2024

(54) SAFETY HELMET WITH AN ADAPTER AND PROCESS FOR DETACHABLY FASTENING A MODULE

(71) Applicant: Dräger Safety AG & Co. KGaA, Lübeck (DE)

(72) Inventor: Jasser Rahmatyan, Lübeck (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 262 days.

(21) Appl. No.: 17/241,350

(22) Filed: Apr. 27, 2021

(65) Prior Publication Data

US 2021/0337914 A1 Nov. 4, 2021

(30) Foreign Application Priority Data

Apr. 30, 2020 (DE) ..... 10 2020 002 613.3

(51) Int. Cl.

| | |
|---|---|
| ***A42B 3/30*** | (2006.01) |
| ***A42B 3/04*** | (2006.01) |
| ***A42B 3/14*** | (2006.01) |
| ***A42B 3/28*** | (2006.01) |

(52) U.S. Cl.

CPC ..... *A42B 3/30* (2013.01); *A42B 3/044* (2013.01); *A42B 3/14* (2013.01); *A42B 3/285* (2013.01); *A42B 3/286* (2013.01)

(58) Field of Classification Search

CPC .. A42B 3/30; A42B 3/044; A42B 3/14; A42B 3/285; A42B 3/286

See application file for complete search history.

(56) References Cited

U.S. PATENT DOCUMENTS

| | | | | |
|---|---|---|---|---|
| 6,608,908 | B1 * | 8/2003 | Galet | H04R 1/1058 379/430 |
| 2004/0261158 | A1 | 12/2004 | Depew et al. | |
| 2006/0218703 | A1 * | 10/2006 | Prendergast | A42B 3/04 2/422 |
| 2009/0322546 | A1 | 12/2009 | Kaneblei et al. | |
| 2016/0329922 | A1 | 11/2016 | Volmer et al. | |

FOREIGN PATENT DOCUMENTS

| | | | |
|---|---|---|---|
| AU | 2013200267 | A1 | 8/2013 |
| DE | 202005004936 | U1 | 7/2005 |
| DE | 602004013317 | T2 | 7/2009 |
| DE | 102013011195 | A1 | 1/2015 |
| EP | 2138060 | A2 | 12/2009 |
| EP | 2138060 | B1 | 6/2016 |
| GB | 2573229 | A | 10/2019 |

* cited by examiner

*Primary Examiner* — Khoa D Huynh
*Assistant Examiner* — Erick I Lopez
(74) *Attorney, Agent, or Firm* — McGlew and Tuttle, P.C.

(57) ABSTRACT

A safety helmet (100) includes a helmet shell (7), with a bearing support structure (2, 5, 9, 21), with a helmet-side coupling point and with a module adapter (1). The bearing support structure (2, 5, 9, 21) is fastened to the helmet shell (7) on an inside. A helmet-side adapter coupling point of the module adapter (1) can be connected detachably to the safety helmet-side adapter coupling point of the module adapter (1). The module adapter (1) holds a module at the safety helmet (100). A process for fastening a module detachably to a safety helmet (100).

18 Claims, 8 Drawing Sheets

SAFETY HELMET WITH AN ADAPTER AND PROCESS FOR DETACHABLY FASTENING A MODULE

CROSS REFERENCE TO RELATED APPLICATIONS

This application claims the benefit of priority under 35 U.S.C. § 119 of German Application 10 2020 002 613.3, filed Apr. 30, 2020, the entire contents of which are incorporated herein by reference.

TECHNICAL FIELD

The present invention pertains to a safety helmet with an arched helmet shell and with a bearing support structure, wherein a module can be detachably fastened to the helmet shell or to the bearing support structure by means of a module adapter. Furthermore, the present invention pertains to a process with which a module can be detachably fastened to a safety helmet.

TECHNICAL BACKGROUND

An example of such a module is an acoustic communication unit, which is capable of outputting acoustic alarms and other messages to a user of the safety helmet and/or is capable of receiving messages spoken by the user. Another example is a transmitting/receiving unit for the transmission of messages by means of radio waves to the user and from the user.

A safety helmet 14 with a helmet shell and with an adapter is described in DE 20 2005 004 936 U1. The adapter comprises an adapter part 1 and an adapter part 2, which can be connected to one another or disconnected from one another with only one hand. The adapter part 1 is arranged on the inner side of the safety helmet 14. The first adapter part 1 can be fastened to the safety helmet 14 by means of two threaded holes 13 at the lower area 11 of the first adapter part 1. The upper area 10 of the first adapter part 1 has two guide rails 3a, 3b. The second adapter part 2 can be inserted (pushed) into these guide rails 3a, 3b. A headset 15 can be connected to the adapter 1, 2.

US 2004/0 261 158 A1 shows a safety helmet ("protective helmet 150") with a helmet shell (shell 152) and with a bearing support structure ("suspension harness 154"), "head band 170 having a nape strap portion 165 and a ratchet sleeve 160"). A "cable strain relief connector 218" can be inserted in a coupling point ("support plate 202, upper flange 204, flower flange 206") at the "nape strap portion 165." A "microphone 207" and a "speaker assembly 108" can be connected hereby to the head band 170.

EP 2 138 060 B1 describes a safety helmet 15 with an outer shell 16 and with a gas-measuring device. The gas-measuring device is divided into an energy supply module 2, a display module 6, an alarm generator module 7 and a sensor module 5. The sensor module 5 measures the gas concentration in the area of the face of the user. An arm 18, which is arranged at the outer shell 15, carries the sensor module 5 and the display module 6.

SUMMARY

A basic object of the present invention is to provide a safety helmet, which is capable of carrying a module with a higher operational reliability than prior-art safety helmets. Furthermore, the basic object of the present invention is to provide a process for inserting a module into a safety helmet, wherein the process causes the module to be held at the safety helmet with a higher operational reliability.

Advantageous embodiments of the safety helmet according to the present invention are, insofar as meaningful, also advantageous embodiments of the process according to the present invention and vice versa.

The safety helmet according to the present invention comprises an arched helmet shell,
a bearing support structure,
at least one helmet-side coupling point,
a first module adapter, and
optionally an additional module adapter.

The bearing support structure is fastened to the helmet shell on the inside. The helmet-side coupling point or each helmet-side coupling point belongs to the bearing support structure or to the helmet shell. It is possible that a helmet-side coupling point belongs to the bearing support structure and another helmet-side coupling point belongs to the helmet shell. The helmet-side coupling point or each helmet-side coupling point is located within the area that is enclosed by the helmet shell.

The first module adapter as well as the optional additional module adapter or each optional additional module adapter comprise a helmet-side adapter coupling point. The helmet-side coupling point of a module adapter is detachably connected to the helmet-side coupling point or to a helmet-side coupling point or can be detachably connected to the helmet-side coupling point or to at least one helmet-side coupling point. The module-side adapter coupling point of the first module adapter can be detachably connected to a module.

The module adapter is capable of holding the module at the safety helmet, providing that the module is connected to the module-side adapter coupling point of the module adapter or of a module adapter and the helmet shell-side adapter coupling point of this module adapter is connected to the helmet-side coupling point or to a helmet-side coupling point.

According to the present invention, the module can be detachably connected to the module adapter. The module adapter can be detachably connected to the safety helmet. Thanks to the present invention, it is possible in many cases to equip a safety helmet with a module later. Furthermore, it is possible to detach an existing module from the safety helmet and to fasten a new module to the safety helmet.

Thanks to the module adapter, it is sufficient for a coupling point of the module to match the module-side adapter coupling point. The present invention makes it possible to connect different modules at the same helmet-side coupling point to the safety helmet one after another. As a result, the same safety helmet according to the present invention can be adapted one after another to different applications, requirements, boundary conditions or even users of the safety helmet. The safety helmet can be modernized by a module being replaced with an improved module. The safety helmet does not need to be adapted for this purpose at all in many cases. Only a new module adapter must be used in other cases, but the helmet-side coupling point may remain unchanged.

The module adapter holds the module at a desired location relative to the safety helmet and thus at a desired location relative to the user of the safety helmet. This desired location is predetermined by the position of the helmet-side coupling point as well as by the geometry of the module adapter. The risk that the module adapter moves to another position than the desired one relative to the head of the user is reduced.

A possible embodiment of the module is that the module outputs acoustic messages to the user of the safety helmet or receives acoustic messages from the user of the safety helmet. The present invention ensures with a relatively high degree of reliability that the module remains at a position relative to the helmet shall at which the module can output and/or receive the messages. In particular, the risk that the helmet shell interferes with the outputting or the reception of acoustic messages is reduced.

The helmet shell of the safety helmet according to the present invention is located, as a rule, at right angles or obliquely above the module adapter and hence also above a connected module. As a result, the helmet shell of the safety helmet protects the module adapter and the module from mechanical and other effects, which may act from a vertical or oblique direction from the top, and often also from laterally acting effects. As a result, the risk of the module adapter or the connected module being damaged is reduced.

The module adapter is connected according to the present invention detachably to the safety helmet and detachably to a module. It is easily possible as a result to replace the existing module adapter by a new module adapter if the existing module adapter is damaged or does not match a module. In addition, it is easily possible to replace the existing module adapter by another module adapter in order to fasten another module at the safety helmet. It is not necessary in most cases to adapt or to remove the bearing support structure.

The module adapter or each module adapter, the rest of the safety helmet and the module or each module can be manufactured independently from one another, even at different locations, and then be assembled at a desired location. Compared to an embodiment in which the entire safety helmet including the module adapter and the module would have to be manufactured together, the present invention saves time and effort in the manufacture.

In one embodiment, the safety helmet according to the present invention comprises two module adapters. Each module adapter comprises a helmet-side adapter coupling point each and a module-side adapter coupling point. In one embodiment, the same helmet-side coupling point can optionally be connected to the helmet-side adapter coupling point of the first module adapter or to the helmet-side adapter coupling point of the additional module adapter.

In one embodiment, the two module adapters have an identical configuration and have, in particular, the same geometry—or two geometries, which are mirror-symmetrical to one another. In another embodiment, the module-side adapter coupling point of the first module adapter differs from the module-side adapter coupling point of the second module adapter, doing so especially in terms of the geometry and/or at least one dimension.

The embodiment with the different module-side adapter coupling points makes it possible optionally to fasten a first module or a second module at the same helmet-side coupling point. These two modules may differ from one another concerning their respective coupling point for coupling with the module adapter, so that the first module can be connected to the first module adapter and the second module to the second module adapter. Thanks to the embodiment, it is not necessary to provide different safety helmets for the two different modules.

In one embodiment, the safety helmet comprises a first helmet-side coupling point and a second helmet-side coupling point. Each helmet-side coupling point can be detachably connected to a respective module adapter. The head of a user is preferably located between these two helmet-side coupling points. If a module is connected to each of the two helmet-side coupling points by means of a respective module adapter, the head of the user is located between these two connected modules. A module is especially preferably located in the vicinity of the ear of the user.

In one embodiment, the two helmet-side coupling points have an identical or mutually mirror-symmetrical configuration. In another embodiment, the two helmet-side coupling points differ from one another concerning their geometry and/or concerning at least one dimension.

In a preferred embodiment, the module adapter or at least one module adapter has a predetermined breaking point. The force and/or the torque that is necessary to break the module adapter at the predetermined breaking point is preferably weaker than the force and/or the torque for breaking the module adapter at another location and is weaker than the force and/or the torque that is necessary to break off the module adapter from the helmet-side coupling point or to break off the module adapter from the helmet-side coupling point or to break off the module from the module adapter. This predetermined breaking point is located between the two adapter coupling points of the module adapter and it is at a spaced location from each adapter coupling point. If a sufficiently strong force or a sufficiently high torque is exerted on the module adapter, the module adapter will break at the predetermined breaking point.

The embodiment with the predetermined breaking point further reduces the risk that a module connected to the module adapter or the helmet-side coupling point will be damaged. A force acting from the outside breaks the module adapter at the predetermined breaking point, i.e., at a defined position, which is located at a spaced location from both adapter coupling points. After the module adapter has broken in itself, the module is not connected to the safety helmet any longer or it is at least not connected to the safety helmet firmly enough. As a result, the risk that the module is damaged or even destroyed by a force acting from the outside is lower. In addition, the risk that the helmet-side coupling point is damaged is lower.

The embodiment with the predetermined breaking point is especially advantageous when the safety helmet falls on the ground or is placed on the ground such that the opening of the helmet shell points downwards and the module adapter thus extends away from the helmet shell and towards the ground. The latter may happen especially if the safety helmet is used for sitting, in which case the rigid helmet shell is arched upward. A force acting from the outside acts on the module especially when the module protrudes over the area that is enclosed by the arched helmet shell. The configuration with the predetermined breaking point prevents in many cases the module or the helmet-side coupling point from being damaged in this situation as well.

The predetermined breaking point divides the module adapter into two segments, namely, a helmet-side segment, between the helmet-side adapter coupling point and the predetermined breaking point, and a module-side segment between the module-side adapter coupling point and the predetermined breaking point. At least the helmet-side segment is especially preferably located entirely within the area that is enclosed by the arched helmet shell. The module-side segment as well as a connected module may project, i.e., protrude, over the enclosed area. Since at least the helmet-side segment is in the enclosed area, the risk that the helmet-side coupling point or a coupling point of a connected module, which is connected to the module-side adapter coupling point, is damaged when a strong force acts on the module adapter, is reduced.

In a preferred embodiment, the helmet-side adapter coupling point of the module adapter or of at least one module adapter comprises a U-shaped fastening element. The helmet-side coupling point or at least one helmet-side coupling point comprises an opening as well as a web. The web adjoins the opening. The fastening element of the helmet-side adapter coupling point can be passed through the opening. After the fastening element has been passed through the opening, the U-shaped fastening element can be moved into a position in which the fastening element encloses the web from both sides.

Only little space is often available in the area that is enclosed by the helmet shell. The embodiment just described with the U-shaped fastening element requires an especially small space to fasten the module adapter at the helmet-side coupling point and to remove it again from the helmet-side coupling point. The embodiment avoids the need to rotate the module adapter relative to the helmet shell, which often requires more space than when the U-shaped fastening element is to be connected to the helmet-side coupling point. These advantages are especially important when the module adapter must be replaced during the use.

The fastening of the module adapter imposes relatively minimal requirements on the helmet-side coupling point. A sufficiently large opening and a free web, which adjoins this opening, as well as optionally at least one through hole are sufficient.

The U-shaped fastening element, which is passed through the opening, preferably encloses the web from both sides. In particular, two legs of the U enclose the web. In one embodiment, a snap connection or a snap-in connection is brought about in this manner. This embodiment does not require any tool for fastening or again detaching the module adapter.

In another embodiment, a screw can be passed through the U-shaped fastening element and through the web. The U-shaped fastening element preferably has two first openings. The web has an additional opening. The screw can be passed through these three openings. The configuration with the screw leads to an especially secure seating of the module adapter and hence of a module at the module adapter. As a rule, only a suitable screwdriver is necessary for fastening and for detaching the module adapter. This configuration reduces the risk of the module adapter inadvertently changing its position relative to the helmet shell or even becoming inadvertently detached from the safety helmet.

The embodiment with the snap connection and the embodiment with the screw may also be combined with one another, especially in order to provide redundancy.

It is possible that the module adapter or at least one module adapter protrudes over the area that is enclosed by the helmet shell. In another embodiment, the module adapter or at least one module adapter is located entirely in the area that is enclosed by the helmet shell. As a result, the helmet shell protects this module adapter from mechanical effects acting from above and from the side. It is possible to place the safety helmet with the opening pointing downward on a flat base without the module adapter breaking off or breaking.

According to the present invention, the helmet shell-side adapter coupling point of a module adapter can be detachably connected to the helmet-side coupling point or to a helmet-side coupling point. This detachable connection is established in one embodiment by the module adapter being linearly displaced towards the helmet-side coupling point such that the helmet-side adapter coupling point points towards the helmet-side coupling point. For example, a snap connection or snap-in connection is then established between the module adapter and the helmet-side coupling point. This embodiment requires in many cases less space, especially because it is not necessary to rotate the module adapter in order to connect it to the rest of the safety helmet. Little space is often available precisely in the vicinity of the helmet-side coupling point. How the module adapter is connected to the rest of the safety helmet is self-explanatory and, as a rule, intuitive for a user.

The module-side adapter coupling point of a module adapter can be detachably connected according to the present invention to a module. This detachable connection is established in one embodiment by the module being linearly displaced towards the module-side adapter coupling point such that a corresponding coupling point of the module points towards the module-side adapter coupling point. For example, a snap connection or snap-in connection is established hereby between the module adapter and the module. Thanks to this embodiment, it is not necessary to rotate the module relative to the safety helmet in order to fasten it to the module adapter. The risk of the module adapter being damaged is often higher during such a rotation than in case of a linear movement. A tool is often unnecessary for connecting a module to the module adapter.

In one embodiment, the module adapter or at least one module adapter extends in one plane. The module adapter has a spacer. This spacer is positioned at right angles or obliquely to this plane. This spacer ensures in many cases that the module adapter has a sufficient distance from the bearing support structure, and it limits the possible movement of a connected module relative to the safety helmet.

According to the present invention, the safety helmet comprises a bearing support structure, an arched helmet shell and at least one helmet-side coupling point, which belongs to the bearing support structure or to the helmet shell. In one embodiment, the bearing support structure comprises a bearing ring. This bearing ring encloses the head of a user of the safety helmet. The length of the bearing ring and hence the head size, which the safety helmet provides, can preferably be changed. The holding ring is connected mechanically to both the helmet shell and the bearing ring. The holding ring is located entirely or at least in one segment between the bearing ring and the helmet shell. As a result, a distance, which makes it easier to change the head size and hence to adapt the safety helmet to different head shapes of a user, is formed between the bearing ring and the helmet shell.

In a variant of this embodiment, the helmet-side coupling point or at least one helmet-side coupling point belongs to the holding ring. The module adapter can be detachably connected to the holding ring or is detachably connected to the holding ring. This embodiment ensures in many cases that a module, which is connected to this helmet-side coupling point by means of a module adapter, has always the same position relative to the head of a user, doing so largely regardless of the set head size of the bearing ring. The holding ring can be made mechanically more stable in many cases than can the bearing ring, which provides a variable head size.

The embodiment in which the module adapter can be fastened to the holding ring holds the module adapter and a module connected to it in a desired position relative to a user of the safety helmet with an even greater reliability than do other embodiments. The bearing ring is, as a rule, flexible, so that it can adapted itself by itself to the shape of the head of the user. The holding ring with the helmet-side coupling point is preferably adapted to the shape of the arched helmet shell and changes its shape, as a rule, relatively slightly in case of a change in the head size.

This embodiment makes it, in addition, easier in many cases to hold the adapter and hence a connected module at a sufficiently great distance from the head of the user.

In a different embodiment, the helmet-side coupling point or at least one helmet-side coupling point is arranged between the bearing ring and the holding ring. It is also possible that the helmet-side coupling point or a helmet-side coupling point is connected to the helmet shell.

The present invention pertains, furthermore, to a process for inserting a module into a safety helmet and for connecting it detachably to the safety helmet. The safety helmet comprises an arched helmet shell, a bearing support structure, at least one module adapter and at least one helmet-side coupling point. The module adapter comprises a helmet-side adapter coupling point and a module-side adapter coupling point.

The safety helmet, the module to be inserted and the module adapter or a module adapter are provided.

The following steps are carried out to insert the module:

The helmet-side adapter coupling point of the module adapter is detachably connected to the helmet-side coupling point or to a helmet-side coupling point.

The module is detachably connected to the module-side adapter coupling point.

The module adapter is detachably connected in this manner to the safety helmet, and the module is detachably connected to the module adapter. In one embodiment, the module adapter is connected first to the safety helmet. The module is then connected to the module adapter. In another embodiment, the module is connected first to the module adapter. The module adapter is then connected together with the connected module to the safety helmet.

The module adapter is preferably displaced linearly towards the helmet-side coupling point until the detachable connection between the module adapter and the safety helmet is established. The module is preferably displaced linearly towards the module-side adapter coupling point until the detachable connection is established between the module and the module adapter. Two snap connections or snap-in connections are optionally established.

In a preferred embodiment, a U-shaped fastening element of the helmet-side adapter coupling point is passed through an opening of the helmet-side coupling point. The fastening element is then moved into a position in which the fastening element encloses a web of the helmet-side coupling point, which web adjoins the opening, from two sides. A snap connection is established hereby in one embodiment.

The fastening element is especially preferably secured by means of at least one screw in this position, in which it encloses the web from two sides.

In one embodiment, at least the bearing support structure, the helmet-side coupling point or each helmet-side coupling point and the module adapter or at least one module adapter and preferably each module adapter of a safety helmet according to the present invention are produced by means of at least one 3D printer. Different components of the safety helmet are optionally produced by different 3D printers, also at different locations. The helmet shell is likewise produced by a 3D printer in one embodiment, and it is produced by another manufacturing process in another embodiment. The components are preferably assembled into a safety helmet according to the present invention.

The present invention pertains, on the one hand, to a 3D printer, which is configured to produce the just mentioned components of a safety helmet according to the present invention. In one embodiment, these components are produced by an arrangement having a plurality of 3D printers, and each 3D printer produces at least one component each. On the other hand, the present invention pertains to a computer program, which can be executed on a computer. If the computer program is executed on a computer, the computer actuates at least one 3D printer. The actuated 3D printer produces the just listed components of the safety helmet according to the present invention. The computer optionally actuates a plurality of 3D printers for different components. It is also possible that different computer programs actuate a respective computer each, and each actuated computer produces a respective component of the safety helmet according to the present invention.

The present invention will be described below on the basis of an exemplary embodiments. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
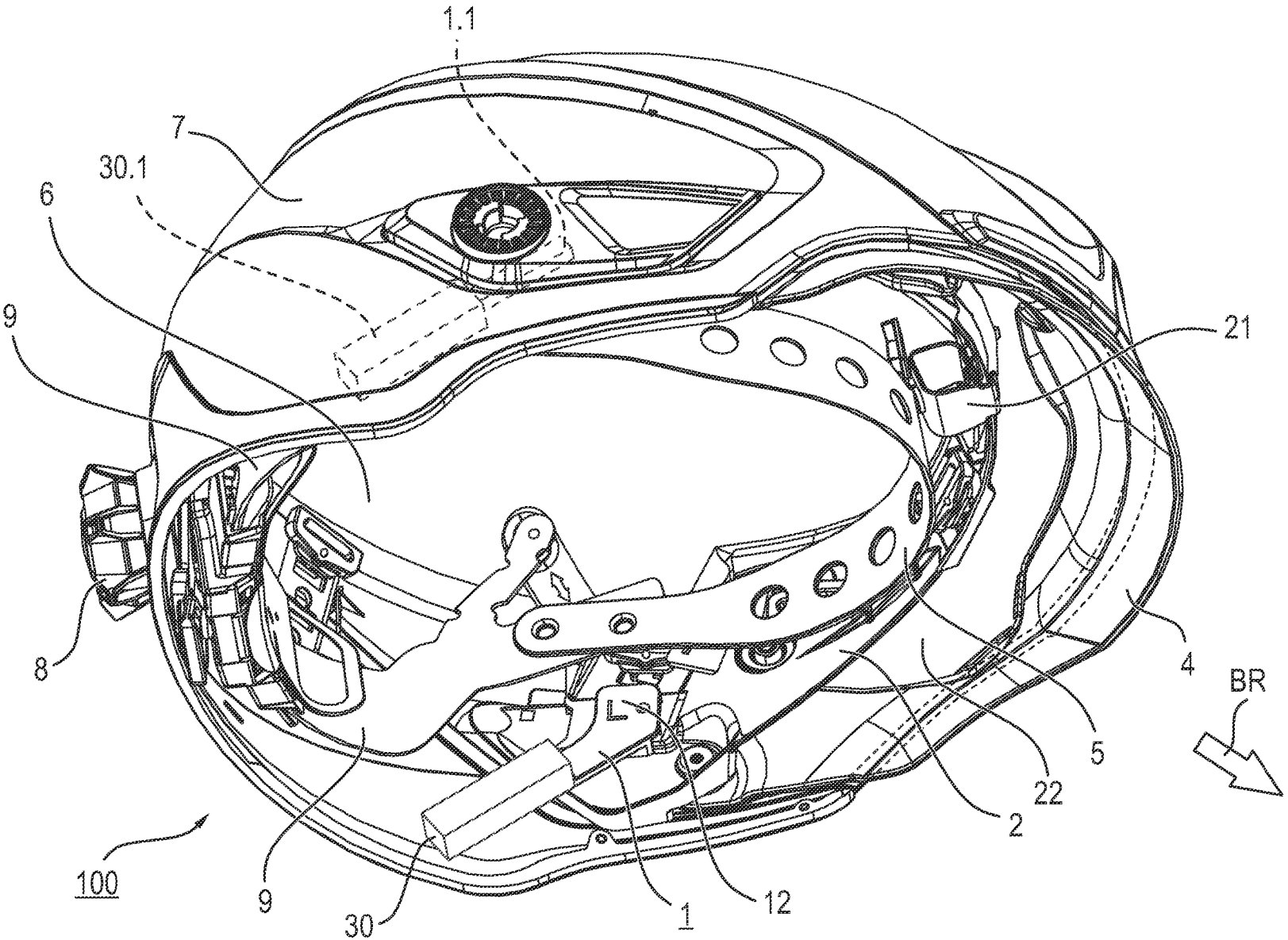
FIG. 1 is a perspective view showing a safety helmet with an inside shown.

Referring to the drawings, the present invention pertains to a safety helmet, which is used by firefighters, police, rescue workers and other rescue team members in order to better protect the head from mechanical, chemical and thermal effects. The person who is using the safety helmet will hereinafter be called "the user." As usual, the safety helmet comprises an arched helmet shell made of a hard material as well as a bearing support structure, which holds the safety helmet on the head of the user. An inner lining is preferably located between the head of the user and the inner side of the helmet shell.

The present invention shows a way of detachably connecting a module to the safety helmet. Examples of such a module, which is connected to the safety helmet and is therefore available to the user of the safety helmet, are a speaker to output messages in an acoustic form to the user, an alarm unit, which outputs an alarm perceptible acoustically or in a tactile manner to the user, a microphone, by means of which the user can enter acoustic messages, a communication module (receiver and/or transmitter) to transmit messages to the safety helmet and/or from the safety helmet by means of radio waves, a vital parameter sensor, which measures a vital parameter of the user, for example, the heart rate or the respiration rate or the blood pressure thereof, a geoposition sensor, which measures its own current geoposition and hence the geoposition of the user, a removable eye protection, for example, a visor or sunglasses, a removable particle mask, which protects the user from particles, a blower, which generates an air stream in the space between the safety helmet and the head of the user and thereby cools the head, a heater, which heats air in the space between the safety helmet and the head of the user, a power supply unit, a light source, a data storage device, and a sensor for harmful substances, especially a gas sensor.

Since the module is fastened to the safety helmet, the module is located at a defined position relative to the head of the user. The module can be fastened to the safety helmet in the exemplary embodiment such that no components of the safety helmet are located between the head of the user and the module. In particular, a damping or other attenuation or distortion of radio waves is caused thereby. The helmet shell of the safety helmet protects the module to a certain extent from environmental effects, especially the effect of mechanical forces in the vertical direction or obliquely from above.

In one embodiment, a camera is fastened to the helmet on the outside. A line, e.g., a glass fiber line, leads to the data storage device in the interior of the safety helmet. In another embodiment, a light is fastened to the safety helmet on the outside. An electrical line leads from the power supply unit to the light.

Figure 3:
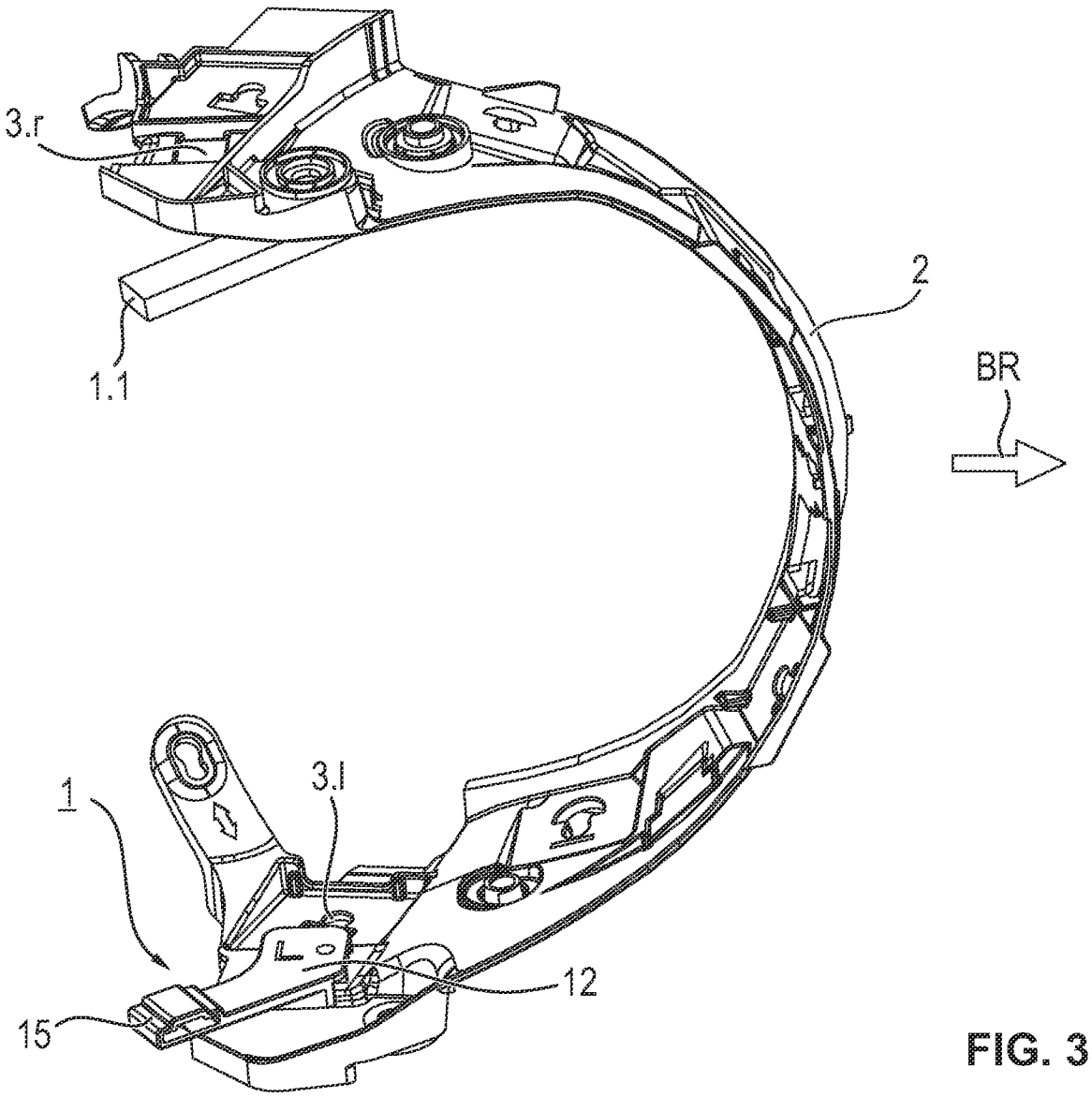
FIG. 3 is a perspective view showing the holding ring of the safety helmet from FIG. 1 with an inserted module adapter.

FIG. 1 shows a safety helmet 100 in a perspective view. This safety helmet 100 comprises the following components:

an arched helmet shell 7 made of a hard material, an arched shock-absorbing shell 6 in the interior of the helmet shell 7, which absorbs kinetic energy, a horseshoe-shaped front holding ring part 2 under a front area of the shock-absorbing shell 6, which is connected to the helmet shell 7, a rear holding ring part under a rear area of the shock-absorbing shell 6, which is connected to the helmet shell 7, a visor 4 between the helmet shell 7 and the front holding ring part 2, which is pivotably fastened to the front holding ring part 2, sunglasses in the form of an additional visor 22, wherein the visor 22 is fastened pivotably to the holding ring part 2, a front bearing ring part 5, which is in contact with the forehead of the user, two rear bearing ring parts 9, both of which are connected to the front bearing ring part 5 in an articulated manner and are in contact with the back of the head of the user, a handwheel 8 at the rear end of the helmet shell 7, by means of which a user can displace the two rear bearing ring parts 9 relative to one another and thereby adapt the length of the bearing ring 5, 9 to the circumference of the head of the user, and a left module adapter 1, which is fastened detachably to the front holding ring part 2 and in the vicinity of the left ear of the user and is capable of holding a module 30 (see FIGS. 1 and 3).

The front holding ring part 2 as well as the rear holding ring part, not shown, are in contact on the inside with the helmet shell 7 and are mechanically connected to the helmet shell 7. The two parts together form a circular holding ring. A distance develops between the front holding ring part 2, on the one hand, and the bearing ring parts 5 and 9, on the other hand. A rigid intermediate piece 21 bridges over the distance between the front holding ring part 2 and the front bearing ring part 5.

A right module adapter 1.1 (schematically in FIG. 1 with dotted lines, behind the helmet shell 7) may be fastened to the front holding ring part 2 close to the right ear of the user and is preferably mirror-symmetrical to the left module adapter 1. The right module adapter 1.1 can carry a further module 30.1 (in FIG. 1 also behind the helmet shell 7).

The designations "left,", "right," "front," "rear," "above" and "under" pertain to the orientation of the safety helmet 100 when the user uses this safety helmet 100 and is looking straight forward. This viewing direction BR of the user looking straight forward is shown in some figures.

The module adapter 1 or each module adapter 1, 1.1 provides a respective detachable mechanical connection between the interior of the safety helmet 100 and a module 30, 30.1. A helmet-side adapter coupling point of the module adapter 1 is adapted to a corresponding helmet-side coupling point in the interior of the safety helmet 100, which will be described in more detail below. A holding arm of the module adapter 1 is adapted to the module 30 to be received. Different modules with the same coupling point can be connected one after another with the same module adapter 1 to the front holding ring part 2. Only the module adapter needs to be replaced to replace a module by another module with a different coupling point, while the rest of the safety helmet 100 can remain unchanged. The geometry of the module adapter 1 can be configured such that the module 30 is held and carried at a desired point relative to the bearing ring 5, 9.

In addition, the module adapter 1 preferably provides a predetermined breaking point. If a higher mechanical load is applied to the interior of the safety helmet 100, the module adapter 1 will be the first to break, before the module 30 being held or the front holding ring part 2 being damaged. After the module adapter 1 has broken at the predetermined breaking point, the module 30 is preferably not connected mechanically to the safety helmet 100 any more. This reduces the risk of damage to the module 30.

Figure 2:
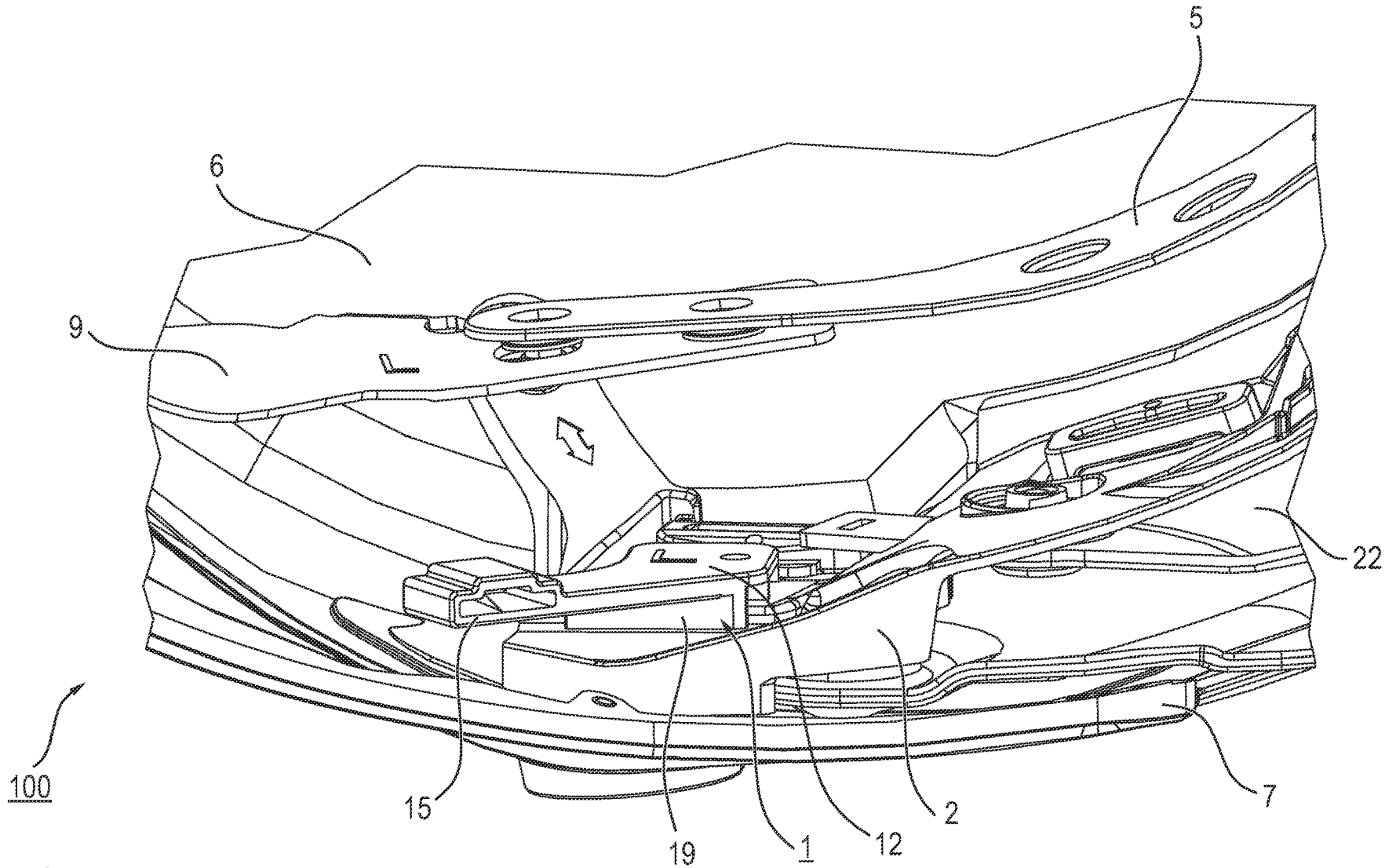
FIG. 2 is a perspective detail view showing the detachable fastening of the module adapter to the holding ring in a viewing direction from below.

FIG. 2 shows a detail of the safety helmet 100 from a nearly vertical viewing direction from below. It can be seen how the left module adapter 1 is fastened to the front holding ring part 2.

Figure 4:
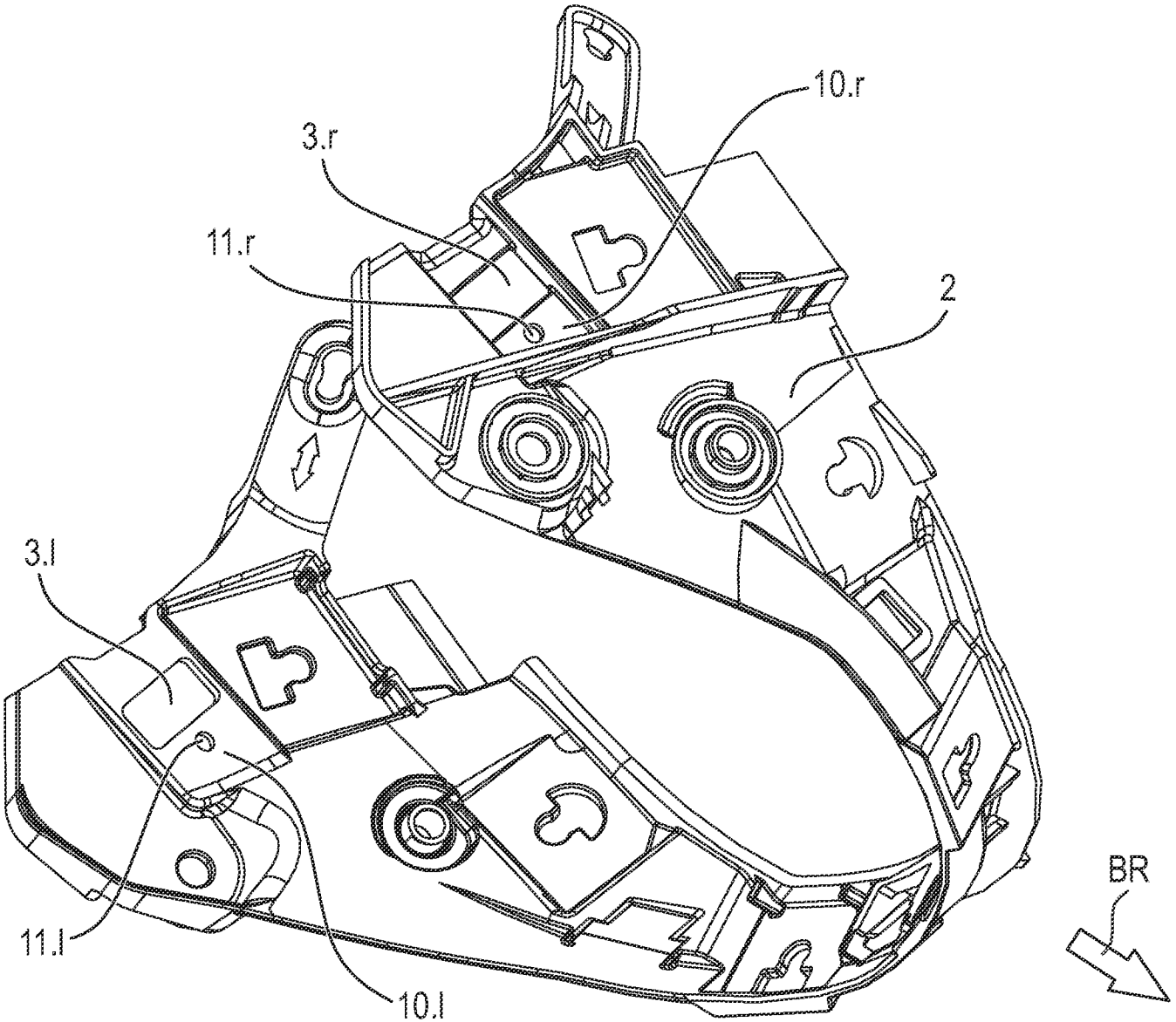
FIG. 4 is a perspective view showing the holding ring of the safety helmet from FIG. 1 without the module adapter.

FIG. 3 and FIG. 4 show the front holding ring part 2 of the safety helmet 100 from FIG. 1. The left module adapter 1 (in FIG. 3 only) as well as the following components of two helmet-side coupling points, which belong to the horseshoe-shaped front holding ring part 2 in the exemplary embodiment, can be seen:

a rectangular left opening 3.*l* and a rectangular right opening 3.*r* close to the two free ends of the front holding ring part 2, a left web 10.*l* and a right web 10.*r* at two ends of the front holding ring part 2, which adjoin the opening 3.*l* and 3.*r*, respectively, as well as a left through hole 11.*l* and a right through hole 11.*r* in the web 10.*l* and 10.*r*, respectively.

The left helmet-side coupling point comprises the parts 3.*l*, 10.*l* and 11.*l*. The right helmet-side coupling point comprises the parts 3.*r*, 10.*r* and 11.*r*. If a respective module adapter 1, 1.*l* with a module 30, 30.*l* is fastened at both helmet-side coupling points, the head of the user is located between these two modules 30 and 30.*l*.

To connect a module adapter 1 to the front holding ring part 2, a U-shaped fastening unit 12 of the adapter 1 is passed through an opening 3.*l*, 3.*r* and inserted (pushed) over the adjacent web 10.*l*, 10.*r*, doing so such that the two legs of the U enclose the web 10.*l*, 10.*r* from two sides. A snap connection is established hereby. A screw 20 is then inserted and is now passed through two holes in the two legs as well as through the through hole 11.*l*, 11.*r*, cf. FIG. 8*c*). These holes may be threaded holes. It is also possible that the screw 20 cuts a thread into the two legs of the fastening unit 12 and/or into the web 10.*l*, 10.*r* while it is being screwed in. The module adapter 1 is connected to the front holding ring part 2 even without a screw thanks to the snap connection.

Figure 5:
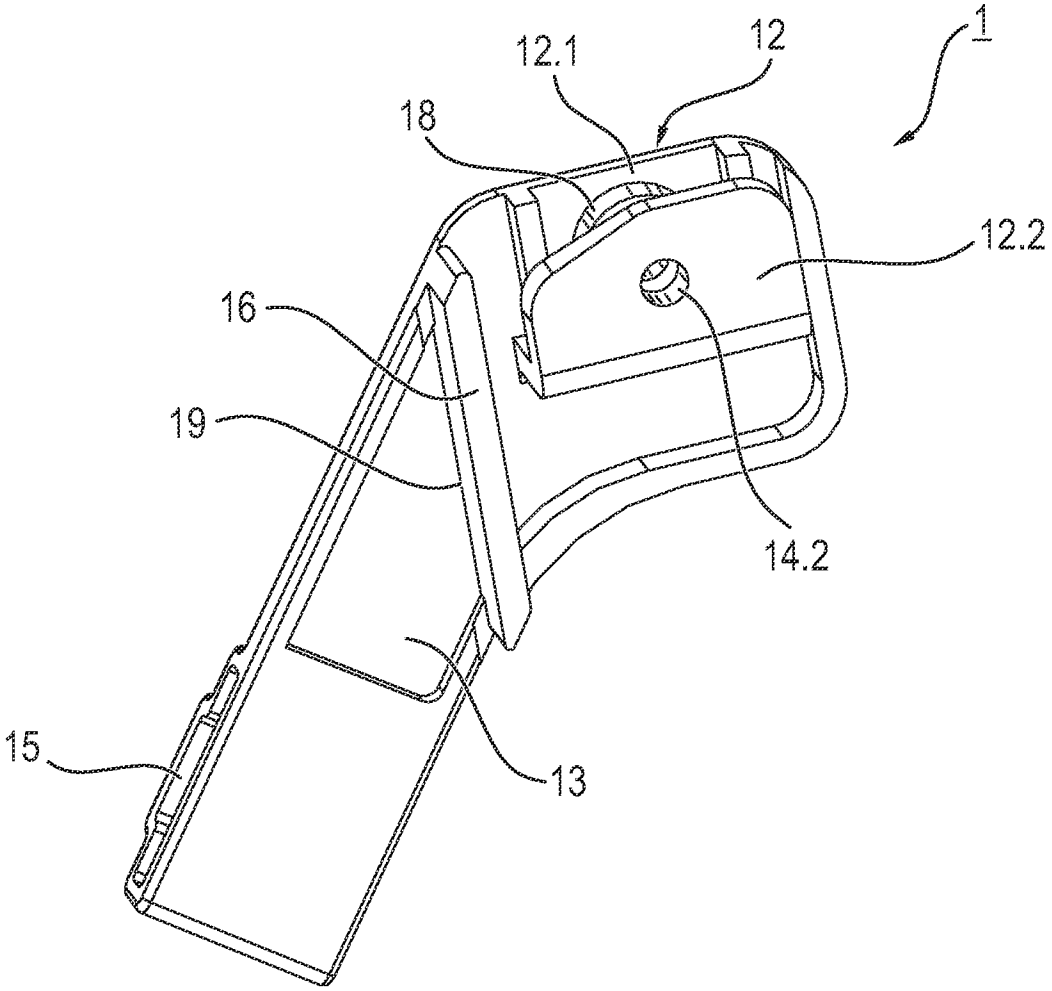
FIG. 5 is a perspective view showing a module adapter from a first viewing direction.
Figure 6:
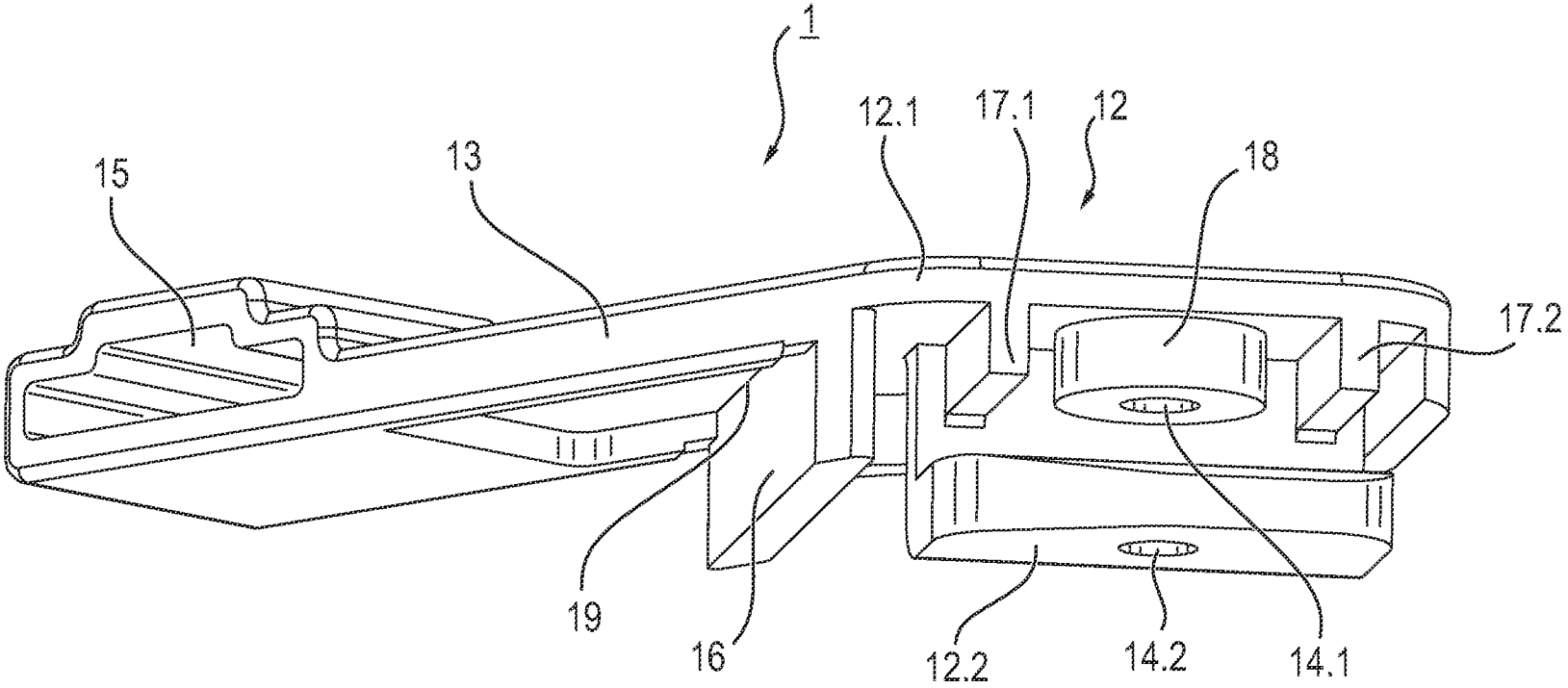
FIG. 6 is a perspective view showing the module adapter from FIG. 5 from a second viewing direction.
Figure 7:
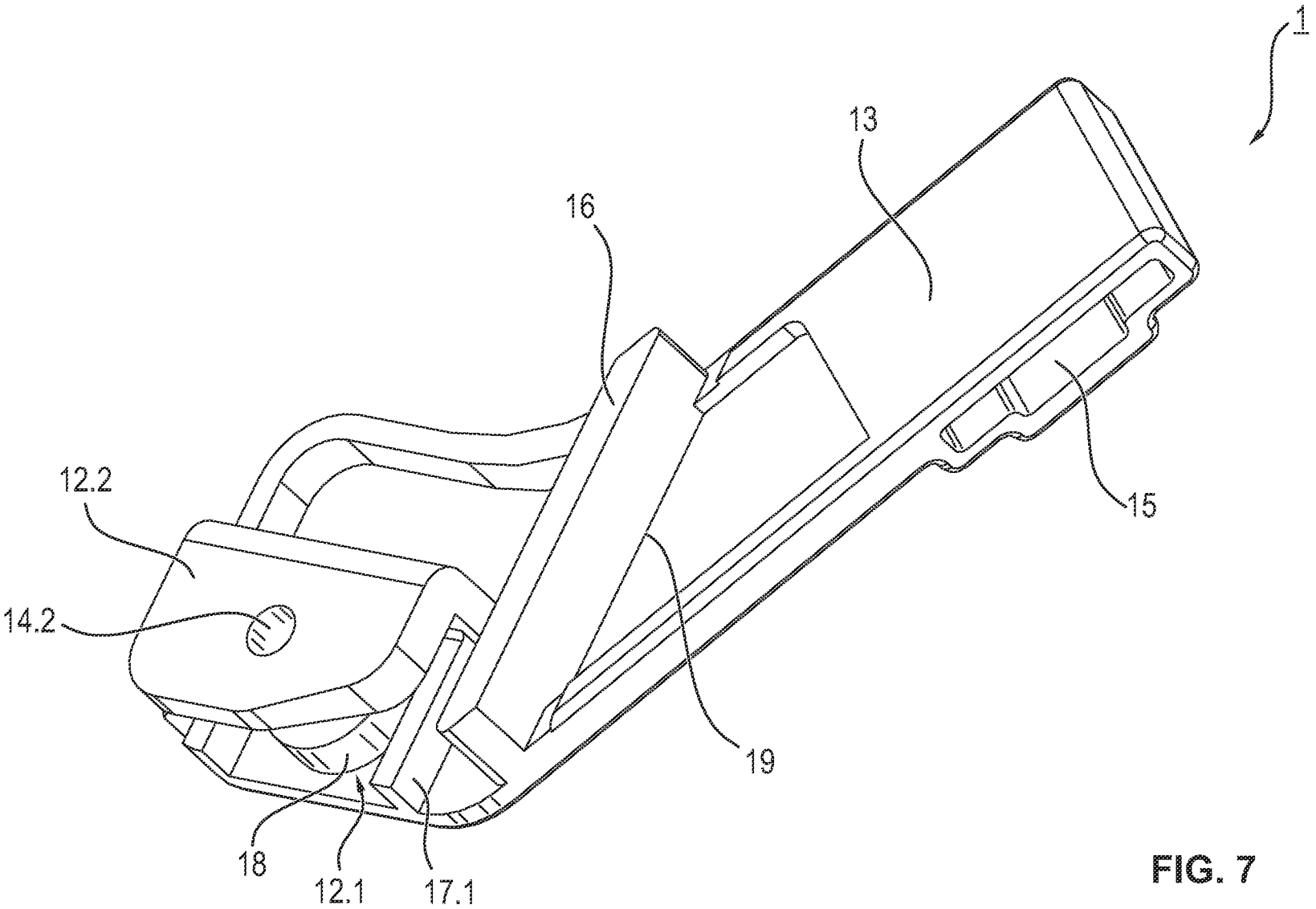
FIG. 7 is a perspective view showing the module adapter from FIG. 5 from a third viewing direction.

FIG. 5 through FIG. 7 show the left module adapter 1 in perspective views from three different viewing directions. The module adapter 1 extends in a plane and comprises the following components:

The U-shaped fastening unit 12 with two legs 12.1, 12.2, two webs 17.1, 17.2 at the leg 12.1, which point towards the other leg 12.2, two holes 14.1, 14.2 in the two legs 12.1, 12.2, optionally configured as threaded holes, a cylindrical border 18 at the leg 12.1, which has the form of a circular ring (torus) and encloses the hole 14.1, an elongated holding arm 13, which is connected to the fastening unit 12 on one side and continues in the leg 12.1, a holding element 15 at the free end of the holding arm 13, into which a corresponding holding element of a module can be inserted, a spacer 16 on the holding arm 13 in the form of a web, wherein the spacer 16 is at right angles to the plane in which the module adapter 1 extends, and a groove 19 over the entire width of the holding arm 13 in parallel to the spacer 16.

The fastening element 12 with the legs 12.*l*, 12.*r* and the two holes 14.*l*, 14.*r* belong to the helmet-side adapter coupling point of the module adapter 1. The holding element 15 belongs to the module-side adapter coupling point.

A module can be connected to the module adapter 1 by a coupling point of the module being inserted (pushed) into the holding element 15. The connection can consequently be established by a simply linear movement.

The two webs 17.1, 17.2 divert a force acting on the fastening element 12 to the front holding ring part 2 and therefore reduce the risk that a pressure acting from the outside on the U-shaped fastening unit 12 causes a leg 12.1, 12.2 to break. The spacer 16 reduces the risk of the holding arm 13 breaking off from the fastening unit 12.

The groove 19 provides a predetermined breaking point. In case of a sufficiently high mechanical load, the module adapter 1 breaks at this predetermined breaking point 19 in itself. At least the segment of the module adapter 1 that is located between the predetermined breaking point 19 and the fastening element 12 is located in the exemplary embodiment entirely within the area that is enclosed by the arched helmet shell 7. The module 30 itself may project/protrude over this area. If the safety helmet 100 is placed on the ground with the opening pointing downward, the module adapter 1 breaks, as a rule, at the predetermined breaking point 19, and the module 30 and the helmet-side coupling point 3.*l*, 10.*l* and 3.*r*, 10.*r*, respectively, remain undamaged in many cases.

The left module adapter 1 is preferably fastened at the front holding ring part 2 as follows:

The fastening unit 12 of the module adapter 1 is inserted into the left opening 3.1 in the front holding ring part 2. The bevel at the leg 12.2 makes it easier to insert the fastening unit 12 into the left opening 3.1.

The fastening unit 12 is then pushed over the left web 10.1 at the front holding ring part 2. The two legs 12.1, 12.2 as well as the border 18 enclose the left web 10.1 from two sides. In one embodiment, the distance between the legs 12.1, 12.2 is greater than is the thickness of the left web 10.1, so that only a relatively weak force must be applied during the pushing. It is also possible that the two legs 12.1, 12.2 clamp the web 10.1 between themselves after the placement.

A screw 20, not shown in FIG. 5 through FIG. 7, is screwed in and is passed in the process through the two holes 14.1, 14.2 as well as through the through hole 11.1. Since the thread of the screw 20 does not come into contact with the through hole 11.1, this through hole 11.1 is also not worn off during several assembly operations. In one embodiment, the screw 20 cuts a thread into the two legs 12.1, 12.2. The two legs 12.1, 12 and the web 11.*l*, 1.*r* prevent the inserted and fastened module adapter 1 from being able to rotate relative to the front holding ring part 2.

Figure 8:
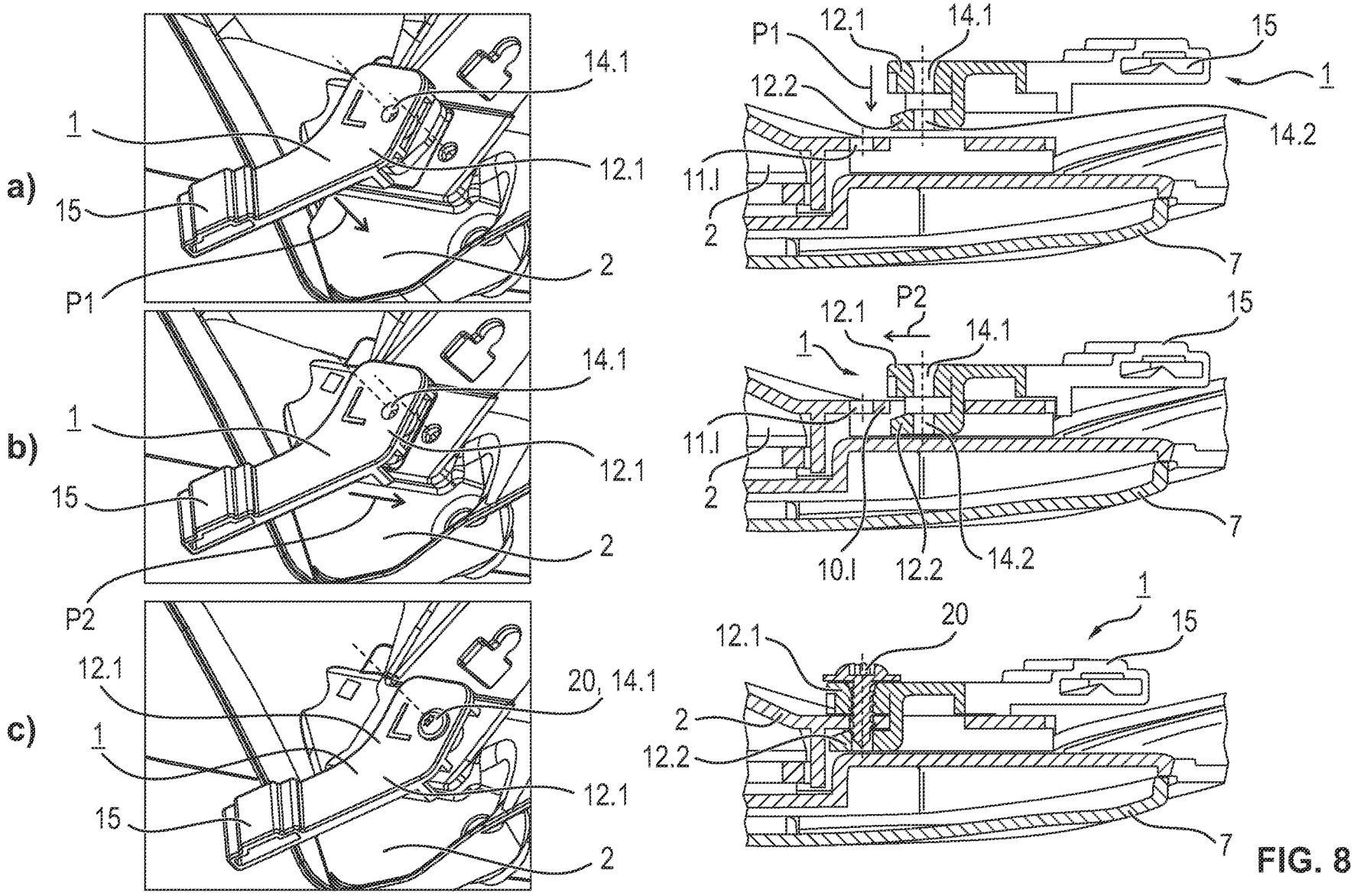
FIG. 8 are perspective and sectional views showing three steps during the insertion of the module adapter.

FIG. 8 shows three steps during the insertion of the left module adapter 1.

The module adapter 1 is brought in the situation designated by a) into a position above the left through hole 11.*l*. The leg 12.2 points towards the front holding ring part 2. The leg 12.2 is passed through the through hole 11.*l* by a movement in the direction of arrow P1.

The leg 12.2 is passed completely through the through hole 11.*l* in the situation shown in b). The module adapter 1 is displaced now in the direction of arrow P2. The direction P2 is at right angles to the direction P1. The legs 12.1 and 12.2 enclose the web 10.*l* in the holding ring 2 from both sides after the displacement and clamp it in one embodiment between themselves. A snap connection is established hereby.

As is shown in c), a screw 20 is now screwed in through the two holes 14.1 and 14.2 in the two legs 12.1 and 12.2. This screw 20 is also passed through the through hole 11.*l*. The screw 20 engages (meshes) with the hole 14.2 in the example shown, without projecting over the leg 12.2.

A right module adapter can be inserted in the same manner into the right helmet-side coupling point 3.*l*, 10.*r*.

In the embodiment described so far, the module adapter 1 can be fastened at the front holding ring part 2. It is also possible to fasten the module adapter 1 at the front bearing ring part 5 at the rear bearing ring part 9. An equivalent of the web 10.*l*, 10.*r* is fastened in this case at a distance from the bearing ring 5, 9, so that an intermediate space, into which the leg 12.2 can be inserted (pushed), is formed between the corresponding web **10.*l*, 10.*r* and the bearing ring 5,9**.

While specific embodiments of the invention have been shown and described in detail to illustrate the application of the principles of the invention, it will be understood that the invention may be embodied otherwise without departing from such principles.

LIST OF REFERENCE CHARACTERS

1 Left module adapter; it holds the module 30 at the front holding ring part 2
1.1 Right module adapter
2 Front holding ring part, fastened on the inside to the helmet shell 7; it holds the left module adapter 1 and a mirror-symmetrical right module adapter
**3.*l* Opening in the front holding ring part 2, through which the fastening unit 12 of the left module adapter 1** is passed
**3.*r* Opening in the front holding ring part 2**, through which the fastening unit of the right module adapter is passed
4 Pivotable visor, fastened to the front holding ring part 2
5 Front bearing ring part; it is in contact with the forehead of a user; it is connected to the two-part rear bearing ring part 9 in an articulated manner
6 Arched shock-absorbing shell in the interior of the helmet shell 7
7 Arched helmet shell; it encloses the shock-absorbing shell 6; holds the front holding ring part 2 and the bearing ring 5, 9
8 Handwheel for adjusting the head size; it acts on the rear bearing ring part 9
9 Two-part rear bearing ring part; connected to the front bearing ring part 5 in an articulated manner
**10.*l* Left web at the front holding ring part 2; it holds the left module adapter 1**
**10.*r* Right web at the front holding ring part 2**; it holds the right module adapter
**11.*l* Left through hole in the left web 10.*l*, through which a screw is passed for fastening the left module adapter 1**
**11.*r* Right through hole in the right web 10.*r***, through which a screw is passed for fastening the right module adapter
12 U-shaped fastening unit of the module adapter 1; it comprises the two legs 12.1, 12.2; belongs to the helmet-side adapter coupling point
12.1 Leg of the fastening unit 12; it extends the holding arm 13; has the hole 14.1; carries the border 18
12.2 Leg of the fastening unit 12; it has the hole 14.2
13 Elongated holding arm of the module adapter 1
14.1 Hole in the leg 12.1, extended through the border 18; optionally configured as a threaded hole; belongs to the helmet-side adapter coupling point
14.2 Hole in the leg 12.2; optionally configured as a threaded hole; belongs to the helmet-side coupling point
15 Holding element at the free end of the holding arm 13; it belongs to the module-side adapter coupling point
16 Spacer on the holding arm 13
17.1,
17.2 Webs at the leg 12.1
18 Cylindrical border 18 at the leg 12.1
19 Groove in the holding arm 13; it provides a predetermined breaking point of the module adapter 1
20 Screw; it holds the module adapter 1 at the front holding ring part 2; passed through the two holes 14.1 and 14.2 as well as through the through hole **11.*l***
21 Rigid intermediate piece between the front holding ring part 2 and the front bearing ring part 5
22 Sunglasses in the form of an additional visor; fastened pivotably to the front holding ring part 2
30 Module at the left module adapter 1
30.1 Module at the right module adapter 1.1
BR Viewing direction of a user of the safety helmet 100, who is looking straight forward

What is claimed is:

1. A safety helmet comprising:
an arched helmet shell;
a bearing support structure fastened on an inside to the helmet shell;
a helmet-side coupling point forming a part of the bearing support structure or of the helmet shell and located within an area enclosed by the helmet shell;
a module adapter comprising a helmet-side adapter coupling point and a module-side adapter coupling point; and
an additional module adapter comprising an additional adapter helmet-side adapter coupling point and an additional adapter module-side adapter coupling point, wherein:
the helmet-side adapter coupling point is connected or detachably connectable to the helmet-side coupling point;
the module-side adapter coupling point is configured to be detachably connected to a module;
the module adapter is configured to hold the module at the safety helmet with the module connected to the module-side adapter coupling point and the helmet shell-side adapter coupling point connected to the helmet-side coupling point;
the helmet-side coupling point is configured to selectively be connectable to the helmet-side adapter coupling point of the module adapter and to the additional adapter helmet-side adapter coupling point of the additional module adapter; and
the module-side adapter coupling point of the module adapter differs from the additional adapter module-side adapter coupling point of the additional module adapter based on geometry thereof or at least one dimension thereof or based on geometry thereof and at least one dimension thereof.

2. The safety helmet in accordance with claim 1, further comprising an additional helmet-side coupling point, wherein:
the additional helmet-side coupling point forms a part of the bearing support structure or of the arched helmet shell;
the additional helmet-side coupling point is located within the area enclosed by the arched helmet shell; and
the helmet-side coupling point and the additional helmet-side coupling point are configured such that a head of a user of the safety helmet is located between the helmet-side coupling point and the additional helmet-side coupling point.

3. The safety helmet in accordance with claim 1, wherein:
the module adapter has a predetermined breaking point; and
the predetermined breaking point is located between the helmet-side adapter coupling point and the module-side adapter coupling point.

4. The safety helmet in accordance with claim 3, wherein a segment of the module adapter that is located between the predetermined breaking point and the helmet shell-side adapter coupling point is arranged entirely within the area enclosed by the arched helmet shell.

5. The safety helmet in accordance with claim 1, wherein:

the helmet-side adapter coupling point of the module adapter comprises a U-shaped fastening element;

the helmet-side coupling point comprises an opening and a web adjoining the opening; and the U-shaped fastening element is configured to be passed through the opening and be moved after passing through the opening into a position in which the U-shaped fastening element encompasses the web from two sides.

6. The safety helmet in accordance with claim 5, wherein:

the U-shaped fastening element has two first openings and the web has an additional opening; and a screw is passed or is passable through both the first openings and the additional opening.

7. The safety helmet in accordance with claim 1, wherein the module adapter is located entirely within the area enclosed by the arched helmet shell.

8. The safety helmet in accordance with claim 1, wherein the module adapter extends in a plane and has a spacer at right angles or in an oblique position relative to the plane.

9. The safety helmet in accordance with claim 1, wherein:

the detachable connection between the helmet-side adapter coupling point and the helmet-side coupling point is establishable by a linear displacement of the module adapter in a direction of the helmet-side coupling point; or the detachable connection between the module-side adapter coupling point and a module is establishable by a linear displacement of the module in the direction of the module-side adapter coupling point; or the detachable connection between the helmet-side adapter coupling point and the helmet-side coupling point is establishable by a linear displacement of the module adapter in a direction of the helmet-side coupling point and the detachable connection between the module-side adapter coupling point and a module is establishable by a linear displacement of the module in the direction of the module-side adapter coupling point.

10. The safety helmet in accordance with claim 1, wherein:

the bearing support structure comprises a bearing ring and a holding ring;

the bearing ring is configured so as to encompass a head of a user of the safety helmet;

the holding ring is connected to the arched helmet shell and to the bearing ring;

the holding ring is located at least partially between the bearing ring and the arched helmet shell; and the helmet-side coupling point forms a part of the holding ring such that the module adapter is connected or detachably connectable to the holding ring.

11. An arrangement comprising:

a module; and a safety helmet comprising: an arched helmet shell; a bearing support structure fastened to the helmet shell; a helmet-side coupling point forming a part of the bearing support structure or of the arched helmet shell and located within an area enclosed by the helmet shell;

a module adapter comprising a helmet-side adapter coupling point and a module-side adapter coupling point, and an additional module adapter comprising an additional adapter helmet-side adapter coupling point and an additional adapter module-side adapter coupling point, wherein:

the helmet-side adapter coupling point is detachably connected or connectable to the helmet-side coupling point;

the module-side adapter coupling point is detachably connected or connected to the module;

the module adapter holds or is configured to hold the module at the safety helmet with the module detachably connected or connectable to the module-side adapter coupling point and the helmet shell-side adapter coupling point detachably connected or connectable to the helmet-side coupling point, wherein the module is detachably connected to connectable to the module adapter of the safety helmet; the helmet-side coupling point is configured to selectively be connectable to the helmet-side adapter coupling point of the module adapter and to the additional adapter helmet-side adapter coupling point of the additional module adapter; and the module-side adapter coupling point of the module adapter differs from the additional adapter module-side adapter coupling point of the additional module adapter based on geometry thereof or at least one dimension thereof or based on geometry thereof and at least one dimension thereof.

12. The arrangement in accordance with claim 11, wherein the module comprises at least one of:

an output unit for outputting acoustic messages to a user of the safety helmet;

an input unit for receiving acoustic messages from a user of the safety helmet;

a communication module for receiving and/or transmitting radio waves;

an alarm unit for outputting an alarm perceptible acoustically and/or in a tactile manner and/or visually;

a vital parameter sensor for measuring vital parameter of a user of the safety helmet;

a geoposition sensor for measuring a geoposition of the module;

a blower configured to generate an air stream in the space between the arched helmet shell and the head of the user of the safety helmet;

a heater configured to heat the space between the arched helmet shell and the head of the user of the safety helmet;

a light source;

a power supply unit; and a data storage device.

13. A process for inserting a module into a safety helmet, the process comprising the steps of:

providing a safety helmet comprising: an arched helmet shell; a bearing support structure; a module adapter; and a helmet-side coupling point, wherein the bearing support structure is fastened to the helmet shell on an inside thereof, the helmet-side coupling point forms a part of the bearing support structure or of the helmet shell and is located within an area enclosed by the helmet shell, and the module adapter comprises a helmet-side adapter coupling point and a module-side adapter coupling point, an additional module adapter comprising an additional adapter helmet-side adapter coupling point and an additional adapter module-side adapter coupling point;

providing a module;

detachably connecting the helmet-side adapter coupling point or the additional helmet-side adapter coupling point to the helmet-side coupling point with a movement of the module adapter or the additional module adapter towards the helmet-side coupling point, until the helmet-side adapter coupling point or the additional helmet-side adapter coupling point engages with the helmet-side coupling point; and detachably connecting the module to the module-side adapter coupling point with a movement of the module-side adapter coupling point until the module engages with the module-side adapter coupling point; and the module-side adapter coupling point of the module adapter differs from the additional adapter module-side adapter coupling point of the additional module adapter based on geometry thereof or at least one dimension thereof or based on geometry thereof and at least one dimension thereof.

14. The process in accordance with claim 13, wherein:

the helmet-side coupling point comprises: an opening; and a web adjoining the opening;

the helmet-side adapter coupling point of the module adapter comprises a U-shaped fastening element; and the step of detachably connecting the helmet-side adapter coupling point to the helmet-side coupling point comprises the following steps:

passing the fastening unit of the module adapter through the opening of the helmet-side coupling point; and moving the U-shaped fastening element passed through the opening into a position in which the U-shaped fastening element encompasses the web of the helmet-side coupling point from two sides.

15. The process in accordance with claim 14, wherein the U-shaped fastening element, which encompasses the web from two sides, is detachably fastened to the web.

16. The process in accordance with claim 13, further comprising providing a computer program which is executable on a computer, wherein the execution causes the computer to actuate a 3D printer such that the actuated 3D printer produces the at least one of a bearing support structure, the helmet-side coupling point and the module adapter.

17. The process according to claim 13, further comprising providing a 3D printer, which is configured to produce at least one of the bearing support structure, the helmet-side coupling point and the module adapter.

18. A safety helmet process comprising:

providing a safety helmet comprising: an arched helmet shell; a bearing support structure fastened to the helmet shell; a helmet-side coupling point connected to the bearing support structure or to the helmet shell and located within an area enclosed by the helmet shell; and a module adapter comprising a helmet-side adapter coupling point and a module-side adapter coupling point, an additional module adapter comprising an additional adapter helmet-side adapter coupling point and an additional adapter module-side adapter coupling point, wherein: the helmet-side adapter coupling point is connected or detachably connectable to the helmet-side coupling point; the module-side adapter coupling point is configured to be detachably connected to a module; and the module adapter is configured to hold the module at the safety helmet with the module connected to the module-side adapter coupling point and the helmet shell-side adapter coupling point connected to the helmet-side coupling point, wherein the helmet-side coupling point is configured to be selectively connectable to the helmet-side adapter coupling point of the module adapter and to the additional adapter helmet-side adapter coupling point of the additional module adapter; and the module-side adapter coupling point of the module adapter differs from the additional adapter module-side adapter coupling point of the additional module adapter based on geometry thereof or at least one dimension thereof or based on geometry thereof and at least one dimension thereof;

providing a 3D printer configured to produce of the bearing support structure, the helmet-side coupling point and the module adapter; and producing at least one of the bearing support structure, the helmet-side coupling point and the module adapter with the 3D printer.

* * * * *